US006285329B1

(12) United States Patent
Nagaev

(10) Patent No.: US 6,285,329 B1
(45) Date of Patent: Sep. 4, 2001

(54) PORTABLE RECEPTION INDICATOR FOR SATELLITE RADIO-NAVIGATION SYSTEMS

(75) Inventor: Farid I. Nagaev, Saint-Petersburg (RU)

(73) Assignee: SamSung Electronics Company, Limited (KR)

( * ) Notice: Subject to any disclaimer, the term of this patent is extended or adjusted under 35 U.S.C. 154(b) by 0 days.

(21) Appl. No.: 09/508,945

(22) PCT Filed: Jul. 20, 1998

(86) PCT No.: PCT/RU98/00231

§ 371 Date: Jun. 9, 2000

§ 102(e) Date: Jun. 9, 2000

(87) PCT Pub. No.: WO00/05780

PCT Pub. Date: Feb. 3, 2000

(51) Int. Cl.[7] ..... H01Q 1/24
(52) U.S. Cl. ..... 343/702; 343/895
(58) Field of Search ..... 343/702, 895; 455/90

(56) References Cited

U.S. PATENT DOCUMENTS 5,255,001 * 10/1993 Tamura et al. ..... 343/702
5,940,039 * 8/1999 Wang et al. ..... 343/702
6,150,984 * 11/2000 Suguro et al. ..... 343/702

* cited by examiner

*Primary Examiner*—Don Wong
*Assistant Examiner*—James Clinger
(74) *Attorney, Agent, or Firm*—Baker & McKenzie

(57) ABSTRACT

The invention relates to the design of radio electronic devices and, more particularly, to antenna-and-feeder facilities to be used in portable (pocket) receiver-indicators of the GPS and GLONASS satellite radio navigation systems (SRNS) using the quadrifilar antennas for reception of signals. The claimed portable receiver-indicator comprises a body, made in the form of a parallelepiped and a quadrifilar antenna made as a parallelepiped and connected to the body with a possibility of rotation, said antenna having a connecting cable. The design enables convenient use of the receiver-indicator while providing its small size and minimum screening effect of the body in the operating position.

1 Claim, 2 Drawing Sheets

PORTABLE RECEPTION INDICATOR FOR SATELLITE RADIO-NAVIGATION SYSTEMS

TECHNICAL FIELD

Figure 1:
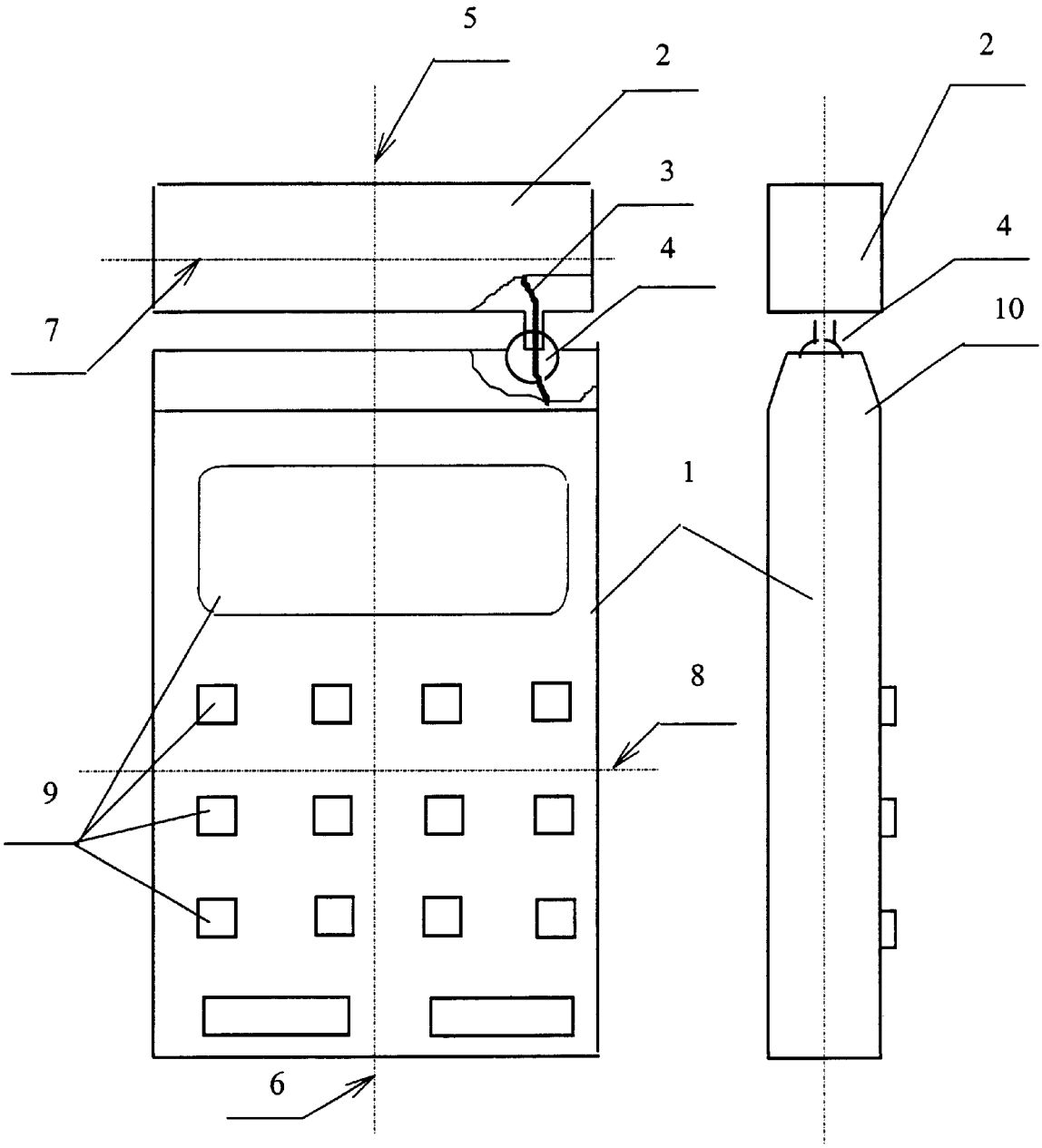

The invention relates to the design of radio electronic devices, including antenna-feeder facilities and can be used in the portable (pocket) receiver-indicators of the GPS and GLONASS satellite radio navigation systems (SRNS) using the quadrifilar antennas for signal reception.

PRIOR ENGINEERING LEVEL

The use of quadrifilar antennas in the receiver-indicators SRNS is advantageously used because the latter have a relatively wide directional pattern and a relatively wide frequency band (compared, for example, with microstrip antennas), acceptable characteristics of the elliptic coefficient and standing-wave ratio, and, most importantly, small dimensions, simple design and a low price (cf. Dyson J. D. Proc. Of the Nat. Electronics Conf. Vol. XVII, 1961, pgs. 206–213). The last-mentioned advantage enables their application in general-purpose pocket-receiver-indicators. A point of particular interest in designing the receiver-indicator is a choice of a place and a way of fixing the quadrifilar antenna on the body to ensure the best operational parameters of the antenna. Known in the art is a design of the portable receiver-indicator, in which the quadrifilar antenna is rigidly secured to the upper part of the body in parallel to its axis of symmetry (cf. GPS World September 1993, p.38, Magellan III). A specific feature of such a design is that for normal reception of the SRNS signals the antenna pattern and, consequently, the antenna and the whole body should be oriented upwards. However, this hinders the manipulation of the controls by the operator since for the ergonomics reasons the control panel should be arranged at an angle of 20° to 30° to the horizon. If the receiver-indicator body is located so that it is convenient for the operator, the intensity of the reflected signals increases, the field of view is reduced, and the thermal noise also increases due to the reception of the earth radiation, thus decreasing the receiver-indicator accuracy.

The closest in technology to the claimed design is the portable receiver-indicator selected as a prior art and comprising a body, elongated in the longitudinal direction and made as a parallelepiped, and a quadrifilar antenna with a connecting cable secured on the side wall of the body and capable of rotating in the elevation-angle plane. Both in the operating and non-operating (storage) position the transversal axes of the antenna and body are parallel (cf. GPC World. December 1994, p.48, Magellan Promark V). This construction allows the receiver-indicator body to be installed in a position convenient for the operator, i.e. with the antenna orientated vertically upwards and body oriented at an angle to the horizontal. The disadvantage of such a construction is an increase of the width of the receiver-indicator by a value equal to antenna cross section that does not enable putting the receiver-indicator into a standard clothing pocket. This construction also partially shields the antenna with the body in the operating position.

DISCLOSURE OF THE INVENTION

The technical task to be solved by the claimed invention is to construct a convenient use portable receiver-indicator while minimizing its size and the screening effect of the body on the antenna in the operating position.

The nature of the invention consists in providing a receiver-indicator for a satellite radio navigation system made in the form of a parallelepiped comprising an elongated body and a quadrifilar antenna with a connecting cable fixed on the body and enabling rotation so that in the operating position the longitudinal axis of the antenna is directed vertically upwards while the longitudinal axis of the body is directed at an angle to the horizontal. The quadrifilar antenna length does not exceed the width of the body and is fixed on the end-face of the upper part of the body through a spherical hinge joint through which the connecting cable passes so that in the storage position the transversal axis of the antenna is parallel to the longitudinal axis of the body, and the longitudinal axis of the antenna is parallel to the transverse axis of the body. While in the operating position, the transverse axes of the antenna and body extend in the directions perpendicular to each other.

The quadrifilar antenna is a four-way spiral whose conductors are excited with identical amplitudes and with 90° phase shift between the adjacent conductors [3]. The conductors are made on the internal or external surface of the body. The length of each conductor is approximately equal to a quarter-wavelength. The maximum of the of the antenna pattern is formed in the direction of axis 7.

PREFERABLE VERSIONS OF REALIZATION OF THE INVENTION

Figure 2:
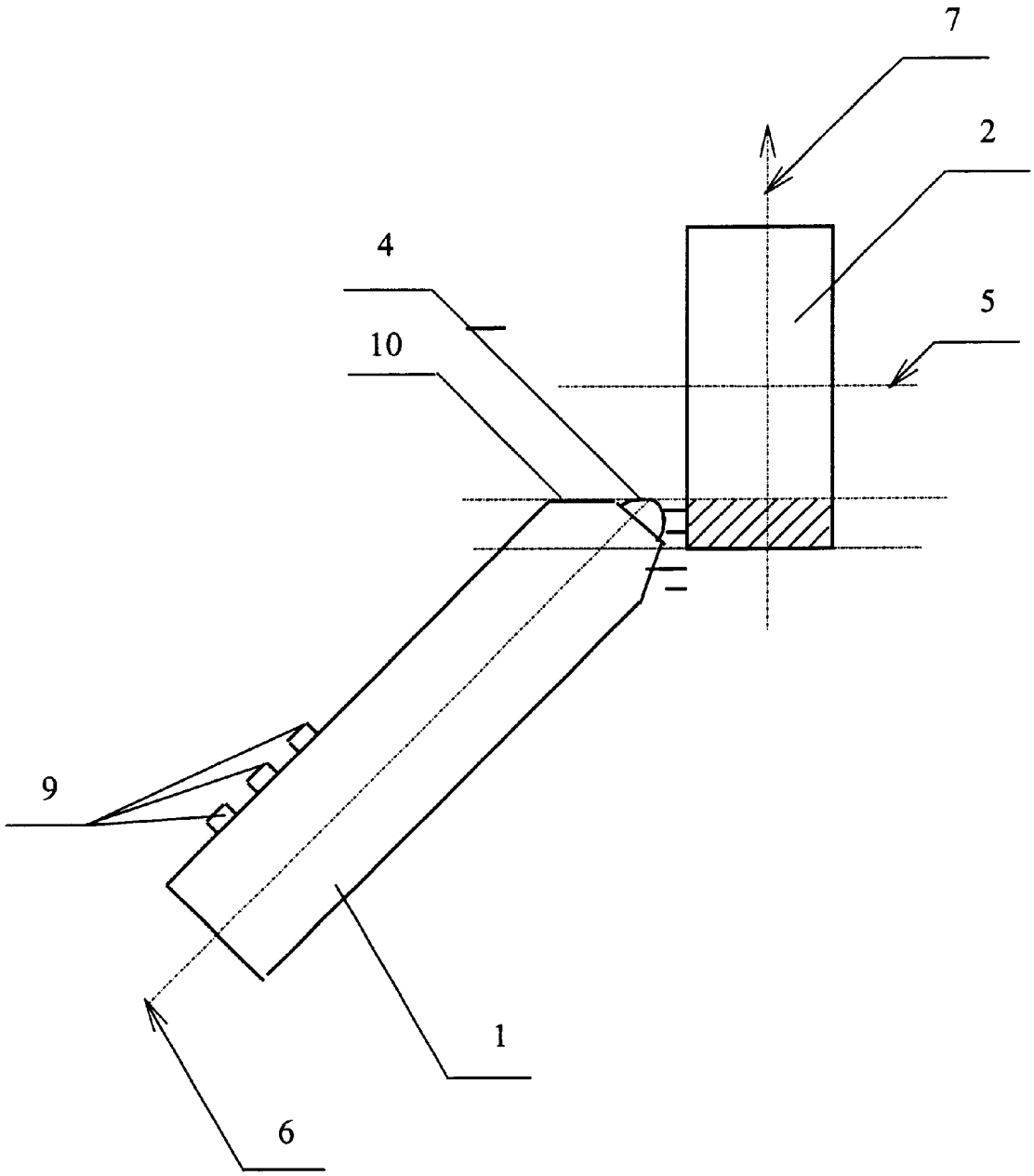

The nature of the invention, its implementation and possibility of industrial application are explained in FIGS. 1 and 2, showing a schematic example of the portable pocket receiver-indicator for satellite radio navigation systems in two positions: in the storage position (FIG. 1) and in the operating position (FIG. 2).

The claimed portable receiver-indicator of the satellite radio navigation systems (FIGS. 1, 2) comprises an elongated body 1, made as a parallelepiped and fixed on the body 1, with a possibility of rotation, is a quadrifilar antenna 2 made as a parallelepiped and having a connecting cable 3. The quadrifilar antenna 2 is connected to the body 1 with the spherical hinge 4, through which passes the connecting cable 3. The spherical hinge 4 is located on an edge of the face surface of the upper part of the body 1. The length of the quadrifilar antenna 2 does no exceed the width of the body 1 and the antenna is fixed to the spherical hinge 4 so that in the storage position the transverse axis 5 of the antenna 2 is parallel to the longitudinal axis 6 of the body 1 and the longitudinal axis 7 of the antenna 2 is parallel the transversal axis 8 of the body 1. The control and indication devices 9 of the receiver-indicator are located on the front face of the body 1 whose upper edge 10 is chamfered.

Shown in FIG. 1 is an example showing the quadrifilar antenna 2 with a length equal to the width of the body 1.

In this case, the transversal axis 5 of the antenna 2 in the storage position coincides with the longitudinal axis 6 of the body 1. Since in the storage position (FIG. 1) the longitudinal axis 6 of the body 1 coincides with the transversal axis 5 the antenna 2 and the transversal axis 8 of the body 1 is parallel to the longitudinal axis 7 of the antenna 2, the antenna 2, whose length corresponds to the width of the body 1, in this position behaves as a natural structural prolongation of the body 1 without extending beyond the width of the latter. This ensures the required minimum dimensions and the convenience of storage, for example, in a pocket of a standard size.

The same requirements are met by the receiver-indicator whose quadrifilar antenna 2 has a length less than the width of the body 1.

In the operating position (FIG. 2), the position of the antenna 2 varies relative to the initial position due to its rotation on the spherical hinge 4. In this case, the direction and angle of turn of the antenna 2 are determined by the operator's convenience when manipulating the controls 9 and by a preset optimal position of the antenna 2, at which the best conditions of reception of the SRNS signals are provided, i.e. The position in which the longitudinal axis 7 of the antenna 2 is directed vertically up and the longitudinal axis 6 the body 1 is at an angle to the horizontal. In this case, the transverse axes 5, 8 of the antenna and body are located in perpendicular directions. The zone of screening the antenna 2 by the body 1 is the zone between the parallel horizontal planes, one of which passes through the lower end face of the antenna 2, and the other one passing through the upper skewed edge 10. Some effect of screening the antenna 2 by the body 1 (shaded part in FIG. 2) in this case practically does not diminish the characteristics of the antenna 2.

For providing an unobstructed turn of the antenna 2 relative to the body 1, connecting cable 3, extending through the spherical hinge 4, for example, via a through central hole or a cavity made in it, is free. In so doing the cable 3 between the points of its fixation in the antenna 2 and in the body 1 (not shown in Figure) can have, for example, a damping bend.

Thus, the combination of said features enables the claimed portable receiver-indicator of satellite radio navigation systems to provide for convenient use of the receiver-indicator while minimizing its dimensions and the screening effect of the body on the antenna while in the operating position.

What is claimed is:

1. The portable receiver-indicator for satellite radio navigation systems comprising a body extended in a longitudinal direction and made in the form of a parallelepiped and a quadrifilar antenna made as a parallelepiped and provided with a connecting cable, said antenna being fixed on the body with a possibility of rotation so that in the operating position the longitudinal axis of the antenna is directed vertically up and the longitudinal axis of the body is directed an angle to the horizontal, characterized in that the length of the quadrifilar antenna does not exceed the width of the body and is fixed on a spherical hinge disposed at the upper part of the body said connecting cable passing through said spherical hinge so that in the storage position the transversal axis of the antenna is parallel to the longitudinal axis of the body, the longitudinal axis of the antenna is parallel to the transversal axis of body, and in the operating position the transversal axes of the antenna and the body are disposed in the perpendicular directions.

* * * * *